United States Patent [19]

Chang

[11] Patent Number: 4,965,008

[45] Date of Patent: Oct. 23, 1990

[54] BAR OF SOAP HAVING A RECESSED PORTION FOR RECEIVING ANOTHER, USED, PIECE OF SOAP

[76] Inventor: Chun-Hsiung Chang, No. 441, Hwa-Shiun IV Tsuen, Chung-Li City, Taiwan

[21] Appl. No.: 421,131

[22] Filed: Oct. 13, 1989

[30] Foreign Application Priority Data

Jun. 23, 1989 [TW] Taiwan ..... 78205965

[51] Int. Cl.[5] ..... C11D 17/00

[52] U.S. Cl. ..... 252/134; 252/174; 252/DIG. 16

[58] Field of Search ..... 252/134, 174, DIG. 16

[56] References Cited

U.S. PATENT DOCUMENTS

| | | | |
|---|---|---|---|
| 1,495,978 | 6/1924 | Anderson | 252/134 |
| 2,271,959 | 2/1942 | Swanson | 252/134 |
| 3,532,633 | 10/1970 | Withers | 252/134 |
| 3,925,225 | 12/1975 | Morrison | 252/90 |

FOREIGN PATENT DOCUMENTS

| | | | |
|---|---|---|---|
| 2654392 | 6/1978 | Fed. Rep. of Germany . | |
| 734565 | 10/1932 | France | 252/134 |
| 741566 | 2/1933 | France . | |
| 1058379 | 3/1934 | France | 242/134 |
| 2479257 | 10/1981 | France . | |
| 2796 | of 1888 | United Kingdom | 252/134 |
| 7935 | of 1898 | United Kingdom | 252/134 |
| 2125427A | 3/1984 | United Kingdom . | |

*Primary Examiner*—Dennis Albrecht
*Attorney, Agent, or Firm*—Ladas & Parry

[57] ABSTRACT

A bar of soap has a recessed portion for receiving another used piece of soap which is to be adhered thereto. The bar of soap has a marked portion formed therein which only becomes exposed when the bar of soap has been worn to a predetermined size adapted to be inserted in the recessed portion of another unused bar of soap having a recessed portion as described above.

4 Claims, 2 Drawing Sheets

BAR OF SOAP HAVING A RECESSED PORTION FOR RECEIVING ANOTHER, USED, PIECE OF SOAP

BACKGROUND OF THE INVENTION

This invention relates to a bar of soap, more particularly to a bar of soap having a recessed portion for receiving another, used, piece of soap.

Bars of soap have become everyday necessities. However, a problem arises when a bar of soap has been used for a long time and gradually reduced to a small, flat piece of soap. Such a piece of used soap is difficult to grasp. Therefore, the piece of used soap is usually thrown away by the user, which means, of course, the soap is wasted.

Sometimes, a used piece of soap is directly depressed onto a new bar of soap, the contact surfaces of both the used piece of soap and the new bar of soap being wetted by water. However, the used piece of soap which is depressed onto the new bar of soap is liable to break and separate from the new soap when the wetted contact surfaces of the used soap and the new soap is dry.

SUMMARY OF THE INVENTION

It is therefore a main object of this invention to provide a bar of soap which can be conveniently and securely engaged with a used piece of soap so as to prevent waste.

Accordingly, a bar of soap of this invention is provided with a recessed portion for receiving a used piece of soap. Whereby, the used piece of soap can be adhered to the recessed portion of said bar of soap by wetting the contact surface of said used piece of soap and the bottom surface of said recessed portion of said bar of soap and depressing said used piece of soap to said recessed portion.

BRIEF DESCRIPTION OF THE DRAWINGS

Other features and advantages of this invention will become apparent in the following detailed description of the preferred embodiments of this invention with reference to the accompanying drawings, in which.

DETAILED DESCRIPTION OF THE PREFERRED EMBODIMENTS

Figure 1:
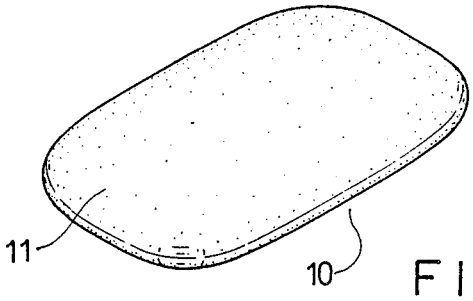
FIG. 1 is a perspective view of a used piece of soap.

Referring to FIG. 1, a perspective view of a used piece of soap 10 is shown. In general, a new bar of soap will gradually wear into a small, flat, generally rectangular piece of soap 10 after a long period of use, as best illustrated in FIG. 1.

Figure 2:
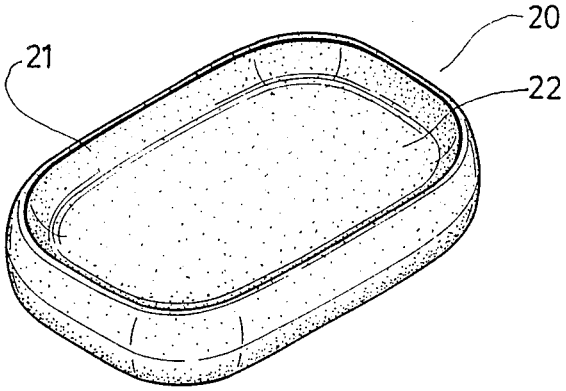
FIG. 2 is a perspective view of a preferred embodiment of a bar of soap of this invention.
Figure 3:
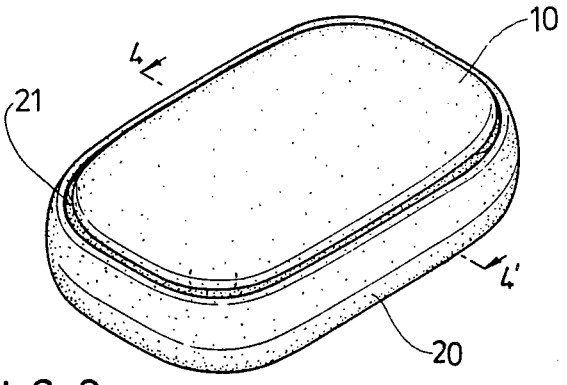
FIG. 3 is a perspective schematic view showing the used piece of soap being received in and adhered to a recessed portion of the bar of soap of this invention.

Referring to FIG. 2, a perspective view of a preferred embodiment of a bar of soap 20 of this invention is shown. Said bar of soap 20 has a recessed portion 21 formed in one face thereof. Preferably, the bottom surface 22 of the recessed portion 21 is designed with a shape similar to that of the contact surface 11 of said used piece of soap 10 so that said used piece of soap 10 can be received in the recessed portion 21 of the bar of soap 20 with said contact surface 11 closely mating with the bottom surface 22 of said recessed portion 21. To adhere said used piece of soap 10 to the bar of soap 20, the contact surface 11 of the used piece of soap 10 and the bottom surface 22 of the bar of soap 20 are wetted with water for softening purposes. The used piece of soap 10 is then pressed into the recessed portion 21 so as to enable the softened contact surface 11 thereof and the softened bottom surface 22 of the bar of soap 20 to combine with each other. In this way, the used piece of soap 10 can be securely adhered in the recessed portion 21 of the bar of soap 20 when the moisture contained between the contact surface 11 of the used piece of soap 10 and the bottom surface 22 of the bar of soap 20 evaporates, as best illustrated in FIG. 3.

Figure 4:
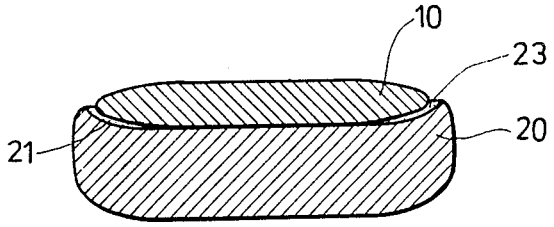
FIG. 4 is a sectional view taken along line 4—4 in FIG. 3.

Referring to FIG. 4, if the contact surface 11 of the used piece of soap 10 and the bottom surface 22 of the bar of soap 20 do not mate perfectly with each other and a clearance 23 is formed therebetween, the used piece of soap 10 can still be adhered to the bar of soap 20 because said clearance 23 will gradually fill with dissolved soap after being used several times.

Figure 5:
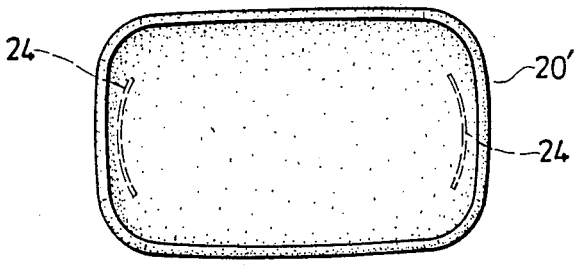
FIG. 5 is a plan view of another preferred embodiment of a bar of soap of this invention.

Referring to FIG. 5, a plan view of another preferred embodiment of a bar of soap 20' of this invention is shown. In this embodiment, the bar of soap 20' has a structure similar to that of the abovementioned embodiment except that this bar of soap 20' has two opposed arcuate portions 24 formed therein of a color which is different from that of the rest of the bar of soap 20', which define an area smaller than the area defined by a used piece of soap to be received in said bar of soap 20'. Therefore, when the bar of soap 20' of this invention is used to an extent to which the arcuate portions 24 are exposed, the user may place the reduced, flat piece of soap into the recessed portion of a new, unused bar of soap of this invention. Thereby, when a bar of soap of this invention is worn to a predetermined size, it can be conveniently and securely adhered to a new bar of soap having a recessed portion in accordance with the present invention so as to prevent unnecessary waste.

With this invention thus explained, it is apparent that numerous modifications and variations can be made without departing from the scope and spirit of this invention. It is therefore intended that this invention be limited only as indicated in the appended claims.

I claim:

1. A bar of soap having a recessed portion for receiving another used piece of soap which is to be adhered thereto, said bar of soap having a marked portion formed therein which only becomes exposed when said bar of soap has been worn to a predetermined size adapted to be inserted into the recessed portion of another unused bar of soap having a recessed portion as described above.

2. A bar of soap as claimed in claim 1, wherein said marked portion is formed by soap which is of a color different than the remaining portion of said bar of soap.

3. A bar of soap as claimed in claim 2, wherein said recess portion has a predetermined area for receiving the used piece of soap and wherein said marked portion comprises a pair of markers disposed within said bar of soap in a confronting relationship, said markers defining, therebetween, an area smaller than the area of said recess portion.

4. The bar of soap of claim 3, wherein said markers have an arcuate configuration.

* * * * *